United States Patent [19]

Offik

[11] 4,142,745

[45] Mar. 6, 1979

[54] METHOD OF MAKING SQUARE KNOT MACRAME

[76] Inventor: Anna W. Offik, 2027 Wooddale Dr., Huntsville, Ala. 35801

[21] Appl. No.: 727,296

[22] Filed: Sep. 27, 1976

[51] Int. Cl.[2] ..... D04G 5/00

[52] U.S. Cl. ..... 289/1.5; 289/18 M

[58] Field of Search ..... 28/15; 289/1.2, 1.5, 289/18

[56] References Cited

PUBLICATIONS

Macramé by the Editor of Sunset Books; Lane Publishing Co., Menlo Park, Ca., copyright 1971; p. 18.

*Primary Examiner*—Louis Rimrodt

*Attorney, Agent, or Firm*—C. A. Phillips

[57] ABSTRACT

A method and means of performing square knot macrame and the product made thereby, wherein the cord arrangement is such that when a change in color from one color to another is desired, the transition is effected by inserting a cord of the second color one cord ahead of the last cord of the first color, whereby all knots carrying two colors are effected solely by a single color of cord, with the other color of cord being present only as a filler cord and obscured by the knots.

3 Claims, 5 Drawing Figures

METHOD OF MAKING SQUARE KNOT MACRAME

BACKGROUND OF THE INVENTION

1. Field of the Invention

This invention relates to the art of macrame, and particularly to a method and means for effecting a color change between cords of one color and cords of another color, and wherein the square knot is used.

2. General Description of the Prior Art

One, if not the basic, knot employed in the art of macrame is the square knot. Many patterns have been published illustrating a variety of items which may be made using this knot. Up until now, there has existed the problem that a transition from one color to another could not be solidly made. That is, where there was a transition from a first color to a second color, there would be splotches of the second color in the first color and the first color in the second color. An example of this is shown in *The Craft Book,* Edited by Colin Elliott at page 82.

Accordingly, it is an object of this invention to provide a method which will eliminate the aforesaid difficulty.

SUMMARY OF THE INVENTION

The inventor has determined that in order to eliminate the problem of undesired color mixture adjacent to a general transition from one color of cord to another, instead of simply employing, as heretofore has been the case, a solid color group of cords up to the cord of color transition and then a solid color group of cords of a second color, one cord of new color is positioned just ahead of the last cord of the old color. In this way, all knots may be made using a single color, with knots involving a transition from one color to another having a cord of each color as filler cords.

DETAILED DESCRIPTION OF THE DRAWINGS

Figure 1:
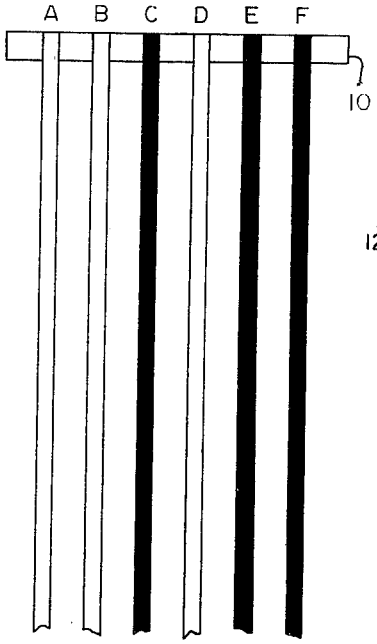
FIGS. 1–3 are pictorial views illustrating basic steps in practicing the present invention.

FIG. 1 illustrates the positioning of cords A–F initially attached, by means not shown, to supporting board 10. Typically, the cords would be attached by pins to board 10. From left to right, cords A and B are of a first color, cord C of a second color, cord D of the first color, and the remaining cords are of the second color. This figure illustrates the basic idea of this invention, showing a single transition between colors.

Figure 2:
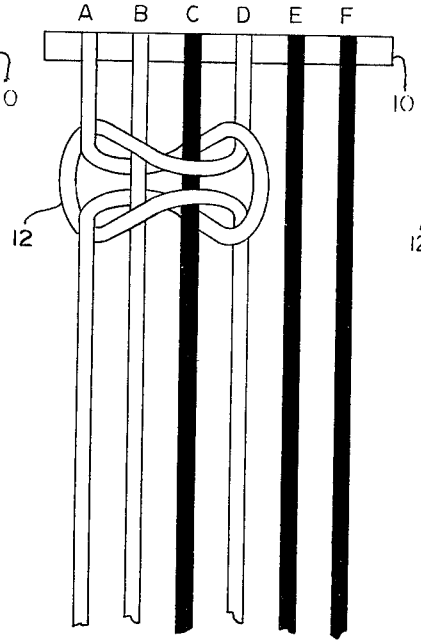

Referring to FIG. 2, a first right-hand square knot 12 is made utilizing cords A and D with cords B and C extending through the center of this square knot as filler cords.

Figure 3:
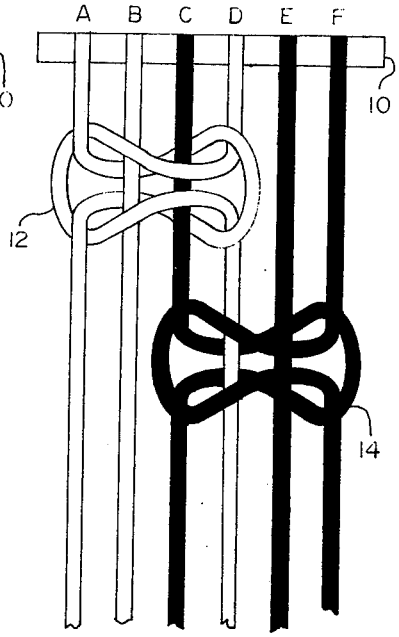

FIG. 3 illustrates the next step of the method wherein a second right-hand square knot 14 is made utilizing cords C and F with cords D and E extending through the center of square knot 14 as filler cords.

Figure 4:
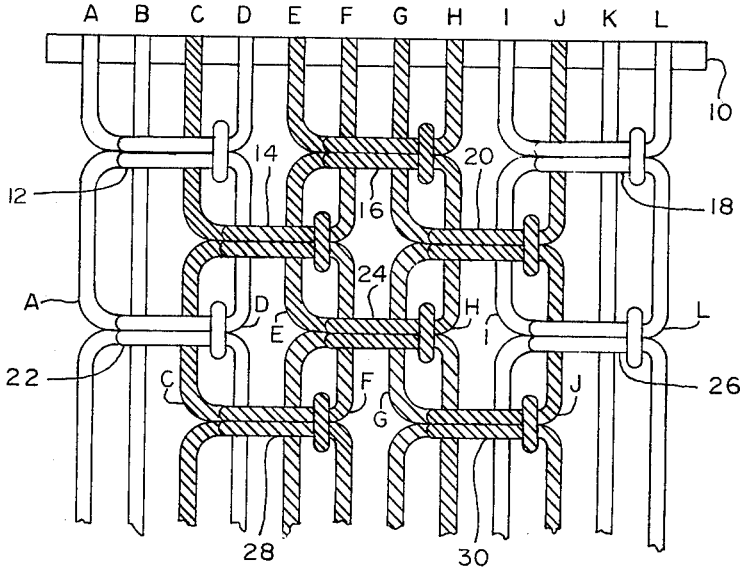
FIG. 4 is a pictorial view illustrating more extensively a fabric formed by means of the present invention.

FIG. 4 illustrates the method of the present invention where there is a transition from a first color to a second color and then back to the first color. Actually, the second transition could be to a third color. As shown, from left to right, cords A and B are of a first color, cord C of a second color, cord D of the first color, cords E–H of the second color, cord I of the first color, cord J of the second color, and cords K and L of the first color. First right-hand square knot 12 is made as shown in FIG. 2 utilizing cords A and D with cords B and C extending through the center of this square knot as filler cords. Next, right-hand square knot 16 is made utilizing cords E and H with cords F and G as filler cords. Next, right-hand square knot 18 is formed utilizing cords I and L with cords J and K as filler cords. Next, right-hand square knot 14 is formed, as in the case of FIG. 3, utilizing cords C and F with cords D and E as filler cords. Next, square knot 20 is formed utilizing cords G and F with cords H and I as filler cords. Thereafter, the method would repeat to form square knots 22, 24, and 26 in a third row and square knots 28 and 30 in a fourth row. Additional rows would be made in the same fashion. Where a wider unit is to be fabricated, which typically would be the case, additional cords would be added for square knots to be formed in each row, with typically one row being completed before a second row would be commenced.

It is to be noted that the pattern of cords vertically remains constant, that is, cords A–L remain in a left-to-right order in any horizontal line drawn through this figure which does not intersect the knot.

Figure 5:
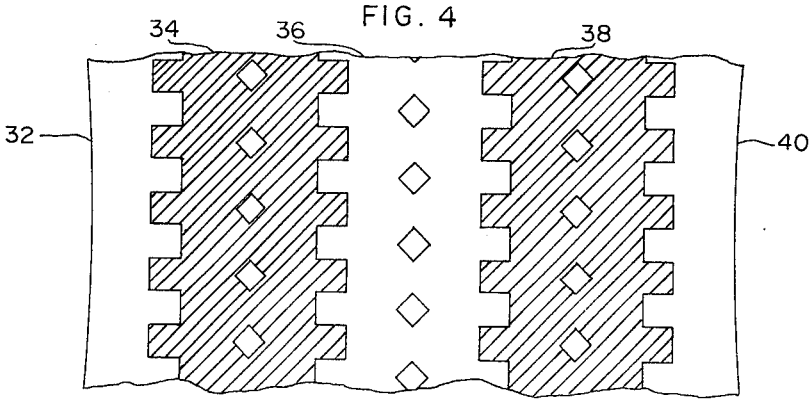
FIG. 5 is a pictorial view illustrating a finished fabric constructed in accordance with the present invention with all cords pulled up reasonably tight.

FIG. 5 illustrates the achievement of color purity by closely forming the knots, and as will be noted, there is a clear break from a first color region 32 to a second color region 34 and then to a third color region 36.

As discussed above, it has not heretofore been possible to make pure color transitions with square knots. An additional problem has been that if a single type of square knot (right-hand or left-hand) is used in an article, even the splotched transitions normally made are unbalanced where there is a transition from a first color to a second color and then back to the first color. In providing both a clean and thus balanced transition in all color transitions, the present invention thus solves both problems.

Having thus described my invention, what is claimed is:

1. A method of performing alternating square knot macrame using cord units of two colors comprising:

positioning a plurality of at least two cord units, cord units A and B, of a first color side by side;

positioning a cord unit C of a second color adjacent to said cord unit B;

positioning a cord unit D of said first color adjacent to said cord unit C;

positioning a plurality of cord units of said second color adjacent to said cord unit D, said last-named plurality including a cord unit E adjacent to said cord unit D, and a cord unit F adjacent to said cord unit E;

making a first square knot utilizing cord units A and D with cord units B and C extending through the center of said first square knot as filler cord units; and making a second square knot utilizing cord units C and F with cord units D and E extending through the center of said second square knot as filler cord units;

whereby a transition from one color to another in an alternating square knot pattern is achieved without leaving residual spots of one color in an otherwise solid pattern of an opposite color.

2. The method as set forth in claim 1 wherein additional cord units G and H, in this order, are positioned to the outside of said cord unit F, and said cord units G and H are of said second color;

a third square knot is made after the making of said first knot and before the making of said second knot utilizing cord units E and H with cord units F and G as filler cord units.

3. The method as set forth in claim 2 wherein:

additional cord units I, J, K, and L are positioned, in this order, on the outside of said cord unit H, and said cord units I, K, and L being of a color different than said first color, and said cord unit J being of a color corresponding to said second color;

subsequent to the making of said third square knot and prior to the making of said second square knot, a fourth square knot is made utilizing cord units I and L with cord units J and K as filler cord units; and subsequent to the making of said second square knot, making a fifth square knot utilizing cord units C and F with cord units D and E as filler cord units.

* * * * *